United States Patent [19]

Fukuroi

[11] 4,015,457

[45] Apr. 5, 1977

[54] INTERLOCKABLE SLIDERS

[75] Inventor: Takeo Fukuroi, Uozu, Japan

[73] Assignee: Yoshida Kogyo Kabushiki Kaisha, Japan

[22] Filed: Feb. 6, 1976

[21] Appl. No.: 655,962

[30] Foreign Application Priority Data

Feb. 10, 1975 Japan ..... 50-18774[U]

[52] U.S. Cl. ..... 70/68; 24/205.15 R; 24/205 R

[51] Int. Cl.[2] ..... A44B 19/26; E05B 67/38

[58] Field of Search ..... 24/205 R, 205.15 R; 70/68, 2; 190/41–42

[56] References Cited

UNITED STATES PATENTS

| | | | |
|---|---|---|---|
| 2,032,019 | 2/1936 | Jordan | 70/68 |
| 2,166,581 | 7/1939 | Carlile | 70/68 |
| 2,398,947 | 4/1946 | Marinsky | 24/205 R |
| 2,621,387 | 12/1952 | Williams | 24/205.15 R |

FOREIGN PATENTS OR APPLICATIONS

| | | | |
|---|---|---|---|
| 240,975 | 6/1946 | Switzerland | 24/205 R |
| 413,825 | 7/1934 | United Kingdom | 70/68 |

*Primary Examiner*—Bernard A. Gelak
*Attorney, Agent, or Firm*—Bucknam and Archer

[57] ABSTRACT

In a two-way closable slide fastener having a pair of sliders arranged reversely to each other on interlocking rows of fastener elements, one of the sliders has a tongue projecting forwardly therefrom, whereas the other slider has a socket for receiving the tongue. Built into the socketed slider is a key-operated lock mechanism including a bolt which can be shot into and withdrawn from the socket by manipulation of the key. When the tongue is inserted into the socket upon closure of the fastener, the bolt selectively engages and disengages the tongue for locking and unlocking the sliders.

4 Claims, 3 Drawing Figures

INTERLOCKABLE SLIDERS

BACKGROUND OF THE INVENTION

This invention relates to slide fasteners, and more specifically to a slide fastener of the two-way closable type having stringers with a pair of sliders positioned thereon reversely to each other so that the fastener may be closed from either end. The invention is even more specifically directed to means for locking as desired the pair of sliders against movement away from each other in their fully closed position on the fastener stringers. The two-way closable slide fastener of this character finds typical application on traveling bags, carrying cases and like articles.

There has been proposed and used a two-way closable slide fastener which has a lock assembly and a hook assembly mounted respectively on the bodies of a pair of sliders and in which the lock and hook assemblies are selectively engaged with and disengaged from each other for locking and unlocking the sliders. The interlockable sliders of this type are complex in construction and expensive of manufacture and assemblage because the lock and hook assemblies must be prepared separately and later assembled with the sliders. Moreover, in the use of the slide fastener, the lock and hook assemblies may loosen with the lapse of time so that the sliders may eventually become unable to be securely locked together.

SUMMARY OF THE INVENTION

It is an object of this invention to provide a two-way closable slide fastener including a pair of reversely directed sliders which, upon closure of the fastener, can be positively locked together against movement relative to each other by materially simplified and inexpensive means incorporated therewith.

Another object of the invention is to provide a pair of interlockable sliders of the character described which is easy and economical of manufacture and which is highly durable in construction.

With these and other objects in view, this invention provides, in a two-way closable slide fastener having a pair of sliders arranged reversely from each other on a pair of stringers, the combination comprising a tongue projecting forwardly from one of the sliders, and a socket formed in the other slider, with the tongue being received in the socket when the sliders are moved into contact with each other to close the fastener. The said other slider has a built-in lock mechanism including a bolt adapted to be shot into and withdrawn from the socket. When the tongue is received in the socket, the bolt is capable of selectively engaging and disengaging the tongue for locking and unlocking the sliders.

According to a preferred embodiment of this invention, the tongue is formed integral with the body of one slider, and the socket is formed in the body of the other slider, so that the sliders can be locked together with their bodies directly interconnected. This arrangement is advantageous because the locking function of the sliders will not easily deteriorate in the use of the fastener and, further, because the sliders can be readily locked together as the tongue fits in the socket upon contact of the sliders with each other at the end of their fastener closing movement.

The invention, both as to its construction and manner of operation, together with the further objects and advantages thereof, will be apparent from the following description of a preferred embodiment thereof, which is to be read in connection with the accompanying drawing in which like reference characters refer to like parts.

DESCRIPTION OF THE PREFERRED EMBODIMENT

Figure 1:
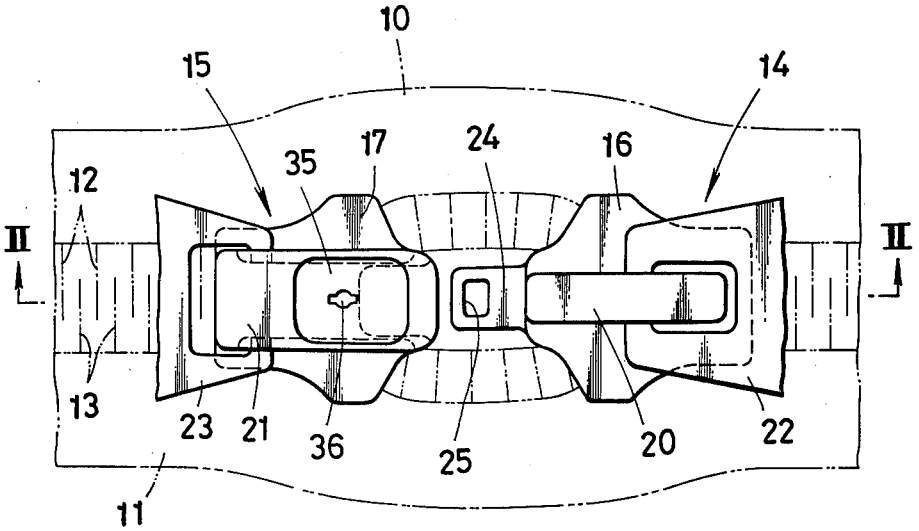
FIG. 1 is a partial top plan view of a two-way closable slide fastener including a preferred form of an interlockable slider pair according to this invention, with the pull tabs of the sliders being shown fragmentarily for the clarity of illustration.
Figure 2:
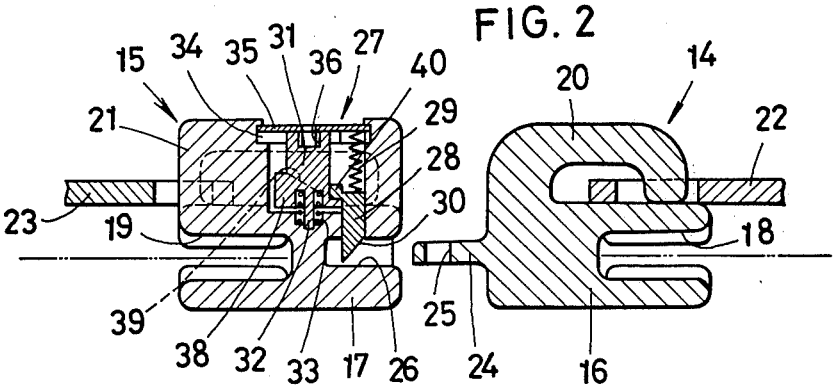
FIG. 2 is a cross-section on line II—II of FIG. 1.

With particular reference to FIGS. 1 and 2, the illustrated form of the two-way closable slide fastener constructed according to this invention comprises a pair of flexible supports or stringer tapes 10 and 11 carrying interlocking rows of fastener elements 12, 13 on their opposed longitudinal edges. In providing a fastener of the two-way closable type, there is arranged on the rows of fastener elements 10 and 11 a pair of sliders 14 and 15 which are disposed reversely to each other, that is, with their flared front ends opposed to each other, so that the fastener may be closed from either end.

The sliders 14 and 15 include bodies 16 and 17 defining therein the usual Y-shaped guide channels 18 and 19, respectively, through which the rows of fastener elements 12 and 13 pass as the sliders are moved therealong to open and close the fastener. The slider bodies 16 and 17 have formed thereon longitudinally extending lugs 20 and 21 to which there are pivotally and slidably attached pull tabs 22 and 23, respectively, for manipulating the sliders.

Figure 3:
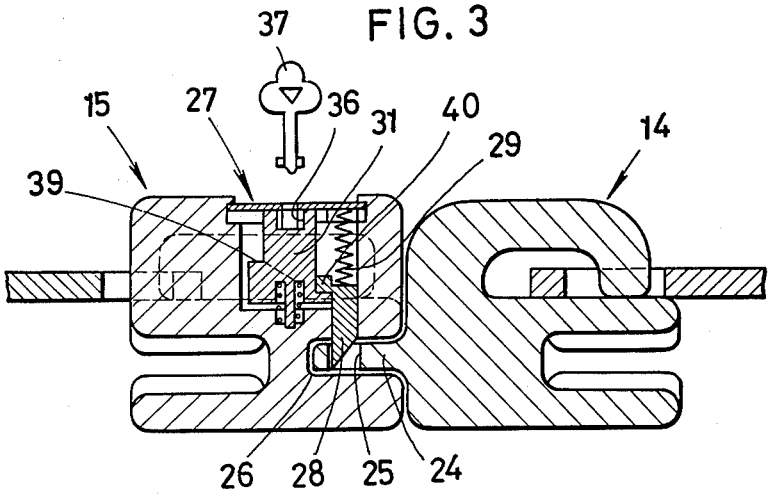
FIG. 3 is a view similar to FIG. 2 but showing the sliders locked together on a larger scale.

According to this invention, the right-hand slider 14, as viewed in the drawing, has a tongue 24 projecting forwardly therefrom, or toward the left-hand slider 15. The tongue 24 is shown to have a rectangular aperture 25 adjacent its front end. The left-hand slider 15 has socket 26 shaped and sized to receive relatively neatly the tongue 24 of the right-hand slider 14 when the two sliders are moved into contact with each other on the rows of fastener elements 12 and 13 as shown in FIG. 3.

As will be seen from FIG. 2, the tongue 24 and the socket 26 should preferably be arranged in coplanar relationship to the guide channels 18 and 19 in the slider bodies 16 and 17. In this manner, when the fastener is attached to a so-called Boston bag or similar article where the sliders are required to travel along a curved path, the relative angular dispositions of the tongue 24 and socket 26 will not greatly vary according to the curvature of the fastener stringers. The tongue 24 can therefore be smoothly moved into and out of the socket 26.

The left-hand slider 15 additionally comprises a built-in lock mechanism generally designated at 27 in FIG. 2. The lock mechanism 27 includes a bolt 28 which can be shot into and withdrawn from the socket 26 and which is biased by a compression coil spring 29 (hereinafter referred to as the bolt spring) toward the socket. When the tongue 24 of the right-hand slider 14 is received in the socket 26, the bolt 28 is movable into and out of the aperture 25 for engaging and disengaging the tongue, that is, for locking and unlocking the sliders 14 and 15. The bolt 28 has a sloping surface 30 at its bottom end so that when the bolt is in the lowered position of FIG. 2, the tongue 24 may be permitted to be inserted fully into the socket 26 by temporarily raising the bolt against the bias of the bolt spring 29.

In this particular embodiment of the invention, the lock mechanism 27 is shown to include, in addition to the bolt 28, a cylindrical tumbler 31 integrally provided with a shaft 32 extending downwardly therefrom in coaxial relationship. The shaft 32 is rotatably supported within the left-hand slider 15, so that the tumbler 31 is rotatable relative to the slider 15 about its own axis. The tumbler 31 is biased upwardly by a compression coil spring 33 (hereinafter referred to as the tumbler spring) arranged thereunder, and the top end of the tumbler is operatively supported by a guide plate 34 having an overlying faceplate 35. A keyhole 36 is formed in the top of the tumbler 31 through the faceplate 35 for insertion of a key 37, FIG. 3, by which the tumbler can be rotated relative to the slider.

In order to translate the rotation of the tumbler 31 into the desired up-and-down motion of the bolt 28 into and out of the socket 26, the tumbler is cammed out at 38 to provide a cam surface 39 over which rides a cam follower 40 integral with the bolt. The cam surface 39 and cam follower 40 are urged against each other by the biasing forces from the bolt spring 29 and tumbler spring 33. Thus, when the tumbler 31 is turned 180 degrees from its position of FIG. 2 or 3 by the key 37, the bolt 28 is withdrawn from the socket 26 against the bias of the bolt spring 29.

In operation, the slide fastener of the foregoing construction can be closed by moving either of the sliders 14 and 15 toward the other, or by moving both sliders toward each other, until the tongue 24 of the right-hand slider is received in the socket 26 of the left-hand slider. If then the bolt 28 of the lock mechanism 27 is in the position of FIG. 2, the bolt will be temporarily raised by the tongue 24 against the bias of the bolt spring 29 and will then be shot into the aperture 25 in the tongue as shown in FIG. 3. Since the bolt 28 is biased downwardly by the bolt spring 29, the sliders 14 and 15 are now inseparably locked together.

For unlocking the sliders, the key 37 may be inserted into the keyhole 36 and turned 180 degrees relative to the slider 15. The tumbler 31 rotates simultaneously with the key 37 about the shaft 32, so that the bolt 28 is withdrawn from the socket 26 against the bias of the bolt spring 29 because then the cam follower 40 formed integral therewith rides on the most elevated position on the cam surface 39 of the tumbler. With the tongue 24 thus released by the bolt 28, the sliders 14 and 15 may be moved away from each other along the rows of fastener elements 12 and 13 to open the fastener.

If desired, the tumbler 31 may be turned 180 degrees back to the position of FIG. 2 or 3 by the key 37 after the fastener has been opened in the above described manner. When the tongue 24 is subsequently inserted into the socket 26 upon closure of the fastener, the sliders 14 and 15 will then be readily locked together.

While the invention has been shown and described in terms of a preferred embodiment thereof, it will be understood that this embodiment is merely for the purpose of illustration and explanation and that various modifications may be made within the scope of this invention as expressed in the following claims.

What is claimed is:

1. In a two-way closable slide fastener which comprises a pair of stringer tapes each carrying along their longitudinal inner edge a row of fastener elements, and a pair of sliders disposed in reverse relationship with their front ends opposed to each other, and movable along the rows of fastener elements so that the slide fastener may be closed by the sliders from either end thereof, each of the sliders having a pair of spaced apart upper and lower portions and a connecting portion interconnecting the upper and lower portions at the front end of the slider to define a guide channel for guiding the rows of fastener elements therethrough, and one of the sliders having a chamber formed in the upper portion thereof, the improvement which comprises in combination: a tongue formed on the connecting portion of the other slider and extending toward the front end of the one slider having said chamber, said tongue having an aperture formed therein; means defining in the connecting portion of said one slider a socket portion for receiving said tongue therein; and a locking means for locking the sliders together, said locking means being contained in said chamber of the upper portion of said one slider and including a generally cylindrical rotating member supported within said chamber for rotation relative thereto, a bolt member, and a biasing means for normally urging said bolt member into said socket portion, said bolt member having a surface cooperating with said biasing means to permit the bolt member to engage said aperture upon insertion of said tongue into said socket portion, and biasing means operatively engaging said bolt member with said cylindrical member to selectively disengage the bolt member from said aperture in response to the rotary movement of said cylindrical member when said tongue is received in said socket portion.

2. The combination of claim 1, wherein said lock mechanism comprises spring means for biasing said bolt toward said socket, a tumbler rotatably supported in said other slider, a key for rotating said tumbler relative to said other slider, and cam means for translating the rotation of said tumbler into the movement of said bolt into and out of said socket.

3. The combination of claim 1, wherein the sliders have guide channels therethrough for the rows of fastener elements, and wherein said tongue of said one slider and said socket of said other slider are disposed in coplanar relationship to the guide channels of the respective sliders.

4. In a slide fastener having a pair of sliders moveable along interlockable rows of fastener elements carried on the opposed longitudinal edges of a pair of stringer tapes, the improvement which comprises a tongue projecting from one of said sliders toward the other slider, lock means integral with said other slider and operable to selectively engage said tongue to lock said sliders together, said lock means including a bolt moveable into and out of engagement with said tongue and a cam moveable by a key and positioned to move said bolt from a locking configuration to a releasing configuration, said other slider including a housing containing said bolt and cam, and having a socket receiving said tongue, said bolt being movable into said socket.

* * * * *